US006488386B1

(12) United States Patent
Yan

(10) Patent No.: US 6,488,386 B1
(45) **Date of Patent: *Dec. 3, 2002**

(54) LIGHTING FIXTURE HAVING AN ELECTRONIC BALLAST REPLACEABLE WITHOUT REWIRING

(75) Inventor: Ellis Yan, South Russell, OH (US)

(73) Assignee: Technical Consumer Products, Inc., Aurora, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/466,028

(22) Filed: Dec. 20, 1999

Related U.S. Application Data

(63) Continuation-in-part of application No. 09/434,555, filed on Nov. 8, 1999.

(51) Int. Cl.[7] ..... F21S 5/00

(52) U.S. Cl. ..... 362/216; 362/216; 362/147; 362/260; 362/226

(58) Field of Search ..... 362/263, 265, 362/216, 226, 260, 147, 404

(56) References Cited

U.S. PATENT DOCUMENTS

| | | | | | |
|---|---|---|---|---|---|
| 3,742,208 | A | | 6/1973 | Mills | |
| 4,029,953 | A | | 6/1977 | Natoli | |
| 4,674,015 | A | * | 6/1987 | Smith | 362/217 |
| 5,128,590 | A | | 7/1992 | Holzer | |
| 5,130,915 | A | | 7/1992 | Lerch | |
| 5,253,152 | A | * | 10/1993 | Yang et al. | 362/226 |
| 5,491,618 | A | | 2/1996 | Vakil | |
| 5,580,158 | A | * | 12/1996 | Aubrey et al. | 362/226 |
| 5,585,688 | A | * | 12/1996 | DeKleine | 313/318.01 |
| 5,700,154 | A | * | 12/1997 | Geary | 439/236 |
| 5,788,533 | A | | 8/1998 | Alvarado-Rodriques | |
| 5,938,316 | A | * | 8/1999 | Yan | 362/260 |
| 6,083,021 | A | * | 7/2000 | Lau | 362/221 |
| 6,124,673 | A | * | 9/2000 | Bishop | 362/260 |

* cited by examiner

*Primary Examiner*—Thomas M. Sember
(74) *Attorney, Agent, or Firm*—Joseph H. Taddeo

(57) ABSTRACT

The present invention relates primarily to a fluorescent lighting fixture having a novel plug-in replaceable electronic ballast that can be replaced without the need of dismantling the installed fixture. In a second embodiment of the present invention, the attachment means is comprised of a ballast housing having a threaded portion that engages the mating threaded indentations found in a recess found in the base of the lighting fixture and is rotatable therein for attachment. This novel attachment and engaging means, thereby reduces the number of components needed for the manufacture of the lighting fixture, concomitantly reducing the assembly time and assembly costs. Alternatively, the attachment means is comprised of a plurality of vanes found typically at the base of the ballast housing as used in a light source apparatus. This attachment means is comprised of a ballast housing having a plurality of vanes that engages the mating threaded indentations found the base of the lighting fixture. The ballast housing is rotatably drawn flat, abutting the surface of the fixture base into a binding frictional engagement. A lamp support bracket, securely attached to the end of the ballast housing opposite its mounting base, is bat-winged shaped to allow the fluorescent lamp to be positioned close to the base of the lighting fixture to permit a stylized dome-shaped cover to be snap-fitted to the base of the fixture. The dome-shaped cover, having a circumferential ridge on its skirt, is securely held in place by snapping the cover past three nibs in the base plate, spaced preferably 120 degrees apart.

14 Claims, 16 Drawing Sheets

LIGHTING FIXTURE HAVING AN ELECTRONIC BALLAST REPLACEABLE WITHOUT REWIRING

REFERENCE TO PREVIOUSLY FILED APPLICATIONS

This application is a continuation-in-part of the prior patent application of Ellis Yan, Ser. No. 09/434,555, LIGHTING FIXTURE HAVING A SCREW LOCK LAMP SUPPORT, filed Nov. 8, 1999. Applicant claims the benefit of the parent domestic application.

FIELD OF THE INVENTION

The present invention relates primarily to a fluorescent lighting fixture having a plug-in replaceable electronic ballast, and more particularly to a fluorescent electronic ballast that can be replaced without the need of dismantling the installed fixture. The present invention also relates to a lighting fixture, illumination source support apparatus having an engaging component insertable into a recess and being rotatable therein for attachment.

BACKGROUND OF THE INVENTION

Many of the present day fluorescent lighting fixtures have a ballasting arrangement where the ballast is an integral part of a fluorescent lighting fixture. These ballasts do not have a life expectancy greater than the fluorescent lamps themselves—their mean-time-between-failures (MTBF) is substantially smaller. Consequently, when a ballast failure occurs, the entire fixture can either be disposed of or, it may become necessary to have someone, such as a licensed electrician, replace the ballast.

Also, the prior art disclosed illumination source support brackets that are mounted to the base of a lighting fixture by using self-tapping screws as the hold-down means for an electronic ballast housing and lamp support bracket. This hold-down means is disadvantageous because of the number of components needed to assemble the lighting fixture and because of the number of operations required during the manufacturing and assembly process. Additonally, this hold-down means may require the need for specialized tools and assembly fixtures to aid in the assembly process.

The following prior art discloses several mounting apparatus as used in other lighting fixtures.

U.S. Pat. No. 5,788,533, granted Aug. 4, 1998, to B. Alvardo-Rodriques, discloses an improved system of interconnecting ballasts and fluorescent lamps. The ballast circuit has wires running from the receptacles to the fluorescent lights.

U.S. Pat. No. 5,401,618, granted Feb. 13, 1996, to U. Vakil, discloses a quick connect/disconnect lighting fixture that requires no tools to install or remove after the initial installation. A typical consumer is then able to convert an existing incandescent lighting fixture to a fluorescent light fixture and maintain it after it is installed.

U.S. Pat. No. 5,130,915, granted Jul. 14, 1992, to D. W. Lerch, discloses a dome shaped decorative fixture that is marketed in kit form with its individual components easily assembled or disassembled. The dome shaped decorative lighting fixture has been designed to be mounted in a ceiling either below a skylight and/or within a housing built into the ceiling.

U.S. Pat. No. 5,128,590, granted Jul. 7, 1992, to W. Holzer, discloses a compact fluorescent lamp and an electronic ballast that is constructed as a separate unit, which constituting an adapter, is electrically and mechanically connectable with the lamp by means of a plug-in connection. The plug-in connection between the ballast and the lamp extends in the direction of the lamp at least partially into the space surrounded by the lamp to achieve the smallest possible length.

U.S. Pat. No. 4,029, 593, granted Jun. 14, 1977, to R. A. Natoli, teaches of a twist lock lamp socket locking means that comprises a lamp socket and panel assembly that includes a socket panel opening having a plurality of equally spaced radially outwardly directed retention slots therein that receive a plurality of circumferentially spaced socket retention tabs on a lamp socket. The socket is rotatably locked in position on the panel using a spring-biased tab located at the end of each ramped surface that engages with retention slots on the panel surface.

U.S. Pat. No. 3,742,208, granted Jun. 26, 1973, to A. Mills, discloses a lighting fixture that utilizes one or more circular fluorescent lamps that is connectable to conventional screw-in or bayonet type sockets. A pair of upper and lower housing members provides a supporting enclosure for the ballast and starter components.

The prior art recited above does not teach of the novel advantages that are found in the present invention.

However, there is a particular need for a fluorescent lighting fixture, having a replaceable electronic ballast that plugs in to its respective ballast receptacle, thereby obviating the need for dismantling the lighting fixture. This need, together with a lamp mounting assembly, that uses less components and specialized tools to assemble the fixture, will result in less time to manufacture and assemble, as well as, reduce the cost.

Accordingly, it is therefore an object of the present invention to provide a lighting fixture having a plug-in replaceable electronic ballast, one that can be replaced without the need for rewiring the ballast to the existing fixture wiring.

It is another object of the present invention to provide a lighting fixture having a novel rotatable ballast housing that supports a light source lamp bracket.

It is still another object of the present invention to provide a lighting fixture having a novel rotatable ballast housing that supports a lamp source bracket, the lighting fixture having fewer components needed to assemble the lighting fixture.

It is still yet another object of the present invention to provide a lighting fixture having a novel rotatable ballast housing that supports a lighting source lamp bracket, where only conventional tools and tooling are needed to assemble the lighting fixture.

Another object of the present invention is to provide a lighting fixture having a novel rotatable ballast housing that supports a lamp source bracket, where the manufacturing and assembly costs are reduced when producing said lighting fixture.

Additionally, it is another object of the present invention to provide a lighting fixture having a novel rotatable ballast housing that supports a lamp source bracket, where safe operation through the secure rotational attachment of the illumination source and its related components is provided.

Still another object of the present invention is to provide a lighting fixture having a novel rotatable ballast housing that supports a lamp source bracket, where the ballast housing is drawn flat abutting the decorative base surface, while maintaining it in position with a binding frictional engagement.

A final object of the present invention is to provide a dome-shaped decorative cover that is snap-fitted into the decorative base, where three nibs subsequently hold it in place.

These as well as other objects and advantages of the present invention will be better understood and appreciated upon reading the following detailed description of the preferred embodiment when taken in conjunction with the accompanying drawings.

SUMMARY OF THE INVENTION

The present invention relates primarily to a fluorescent lighting fixture having a novel attachment and engaging means, principally provided by a plug-in replaceable electronic ballast.

In a first embodiment of the present invention, a plug-in replaceable electronic ballast, having two pins that mate and engage with a ballast receptacle, is provided so that an unskilled user can easily remove and replace an electronic ballast, should the need arise. The ballast receptacle is basically a transition module that has a pre-wired pigtail that connects to the house wiring during the initial installation.

In a second embodiment of the present invention, the attachment means is comprised of a ballast housing having a threaded portion that engages the mating threaded indentations found the base of the lighting fixture. The base of the ballast housing is inserted into the recess found in the base of the lighting fixture. By rotating the ballast housing as it is inserted into the lighting fixture base, the threaded portion of the ballast housing engages the ramped threaded depression in the lighting fixture base, thereby providing a secure attachment for the illumination source assembly. The number of components needed for the manufacture of the lighting fixture is thereby reduced, concomitantly reducing the assembly time and assembly costs.

Alternatively, the attachment means is comprised of a plurality of vanes found typically at the base of the ballast housing as used in a light source apparatus. The base of the ballast housing is inserted into the recess found in the base of the lighting fixture. By rotating the ballast housing as it is inserted into the lighting fixture base, the vanes engage the ramped screw-threadlike depressions in the lighting fixture base to provide a rapid secure attachment support for the illumination source. This means of attachment also reduces the number of components needed to manufacture and assemble the lighting fixture.

A lamp support bracket, securely attached to the end of the ballast housing opposite its mounting base, is bat-winged shaped to allow the fluorescent lamp to be positioned close to the base of the lighting fixture to permit a stylized dome-shaped cover to be snap-fitted to the base of the fixture.

The dome-shaped cover, having a circumferential ridge on its skirt, is securely held in place by snapping the cover past three nibs, spaced preferably 120 degrees apart, in the base plate.

BRIEF DESCRIPTION OF THE DRAWINGS

The present invention is pictorially illustrated in the accompanying drawings that are attached herein.

FIG. 6C the means for mounting

DETAILED DESCRIPTION OF THE INVENTION

Figure 1:
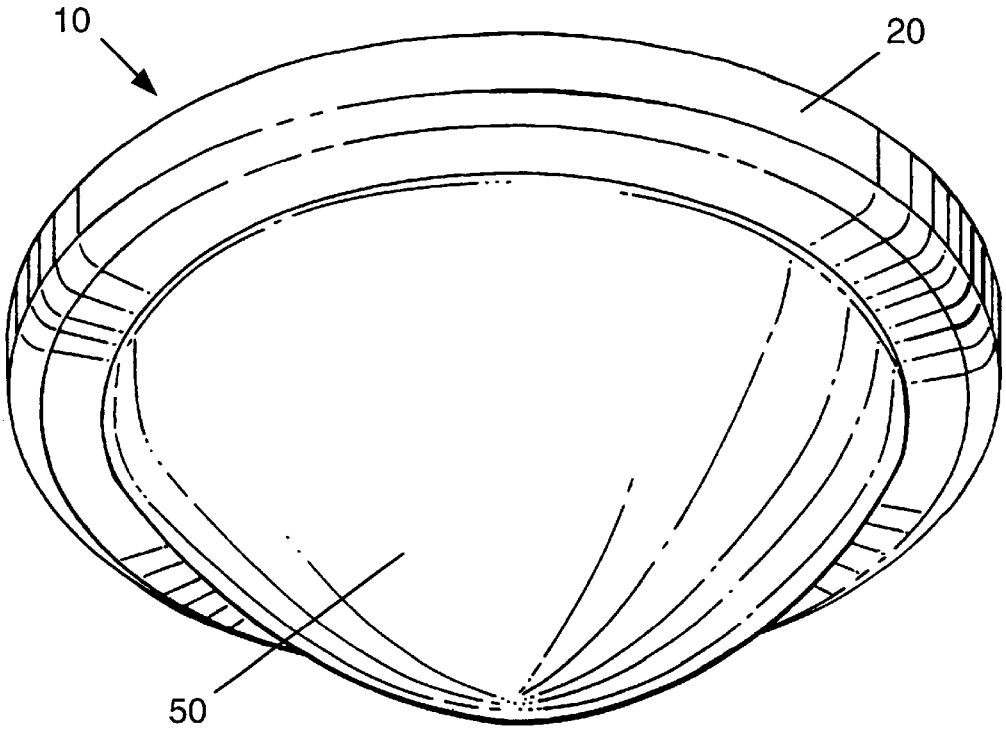
FIG. 1 is a perspective view of the fully assembled lighting fixture that incorporates the preferred embodiment of the present invention.

The fully assembled fluorescent lighting fixture 10, embodying the principles of the present invention, is shown in FIG. 1 preferably as a ceiling mounted fixture. It may also be installed as a wall mounted fixture if so desired. The exterior components are comprised of a decorative lighting fixture base 20 and a decorative dome-shaped cover 50.

Figure 2:
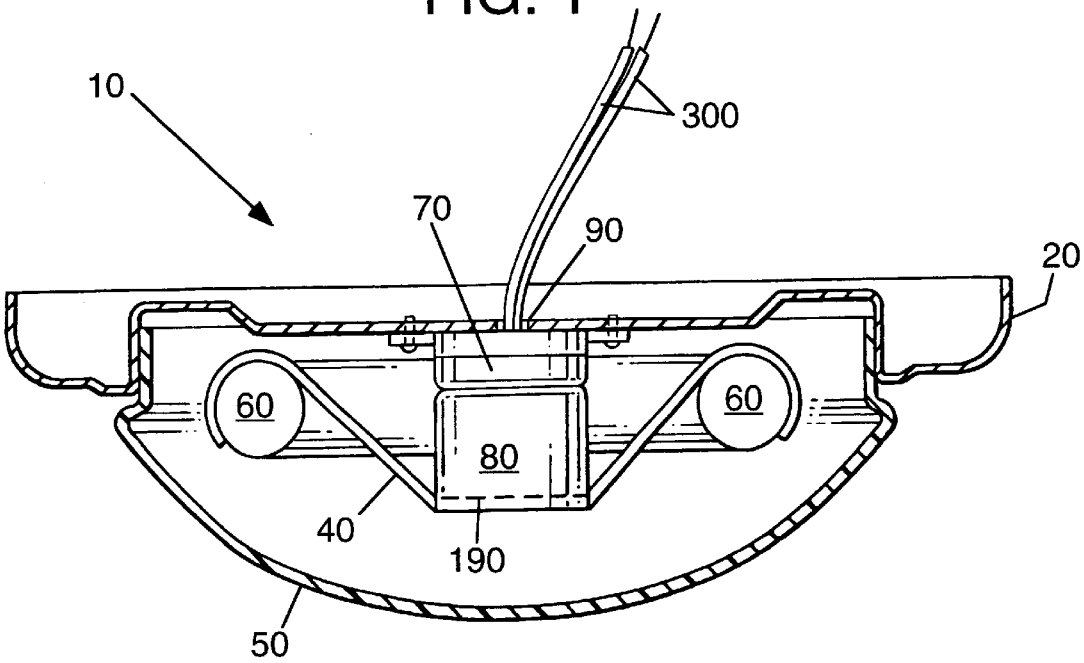
FIG. 2 is a side sectional view of the preferred embodiment of the present lighting fixture.

FIG. 2 shows the electronic ballast 80 inserted into its mating receptacle assembly 70. Two wires (or pigtails) 300, extending from the ballast receptacle assembly 70, protrude through an aperture or opening 90 in the base 20 of the lighting fixture 10. These electrical wires connect to the household wiring during the time of installation. Snap-fitted into the slotted end 190 of the replaceable ballast 80 is a bat-winged shaped lamp support bracket 40. No special tools are required to engage or remove the lamp support bracket 40 from the ballast slot 190 in the ballast housing 30—only a moderate force needs to be exerted.

Figure 3:
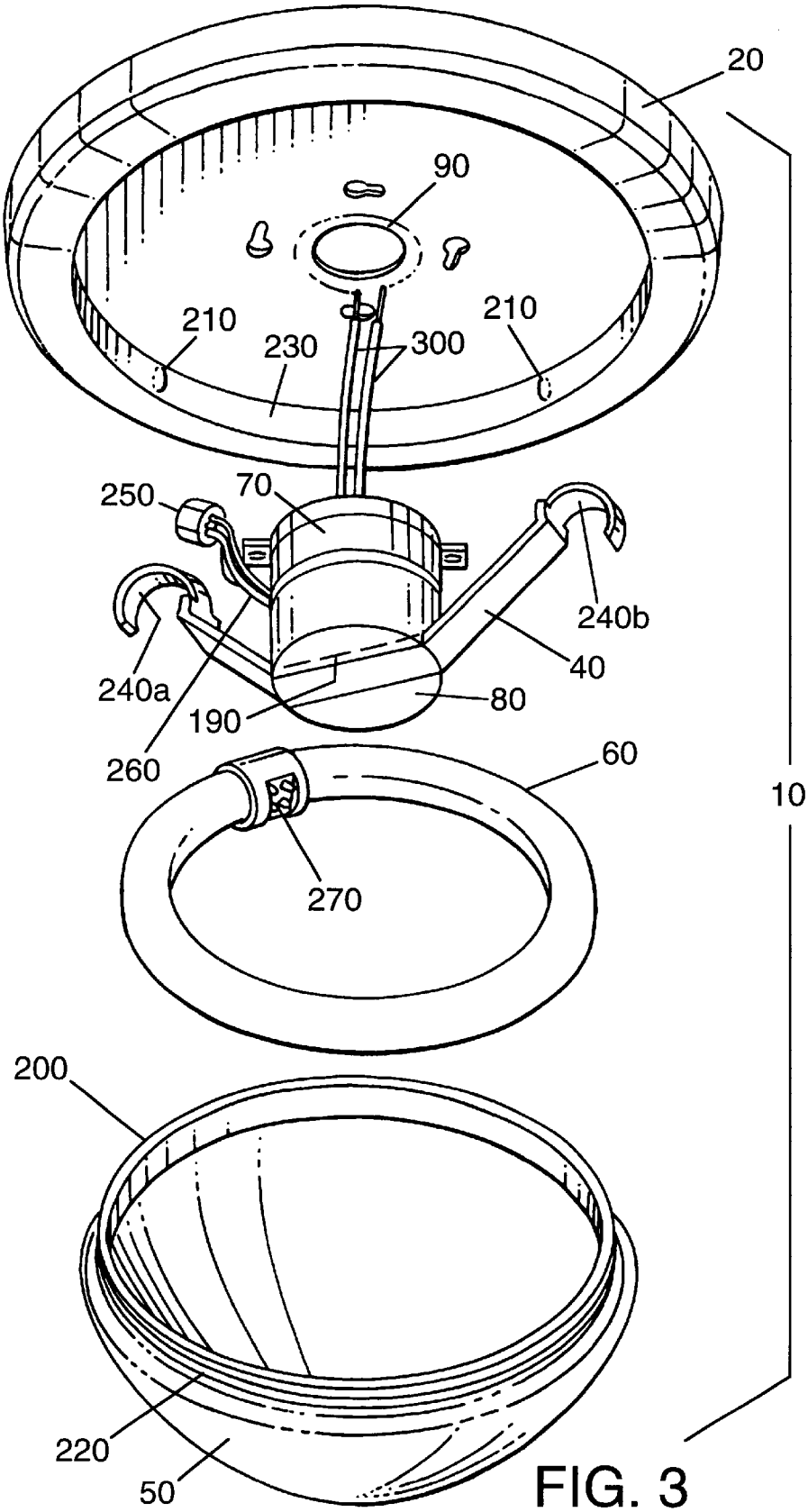
FIG. 3 is an exploded plan view of the lighting fixture as shown in FIG. 1.

Referring now to FIG. 3, the lighting fixture 10 is shown in an exploded plan view, comprising the decorative lighting fixture base 20, the removable lamp ballast 80 inserted into ballast receptacle assembly 70, the lamp support bracket 40, a circular fluorescent lamp 60, and a decorative dome-shaped cover 50.

The wires 300, located at the wired end of the ballast receptacle assembly 70, pass through the recessed threaded hole 90 located in the center of the fixture base 20.

The decorative dome-shaped cover 50 has a ridge 220 on its skirt 200 that extends circumferentially around the outer edge of this skirt—positioned so that the cover is securely held in place by snapping it past the three nibs or projections 210 found in the interior wall 230 of the fixture base 20. The dome-shaped cover 50 is translucent and made preferably from plastic, glass or any other suitable material.

A circular fluorescent lamp 60 may be installed so that it is inserted and nested into the cradled ends 240A and 240B of the lamp support bracket 40. After the fluorescent lamp 60 is mounted in the cradled ends 240A and 240B, the four-wire plug 250 at the end of the cable 260 extending from the ballast housing 80 may be plugged into the fluorescent lamp pins 270.

Figure 4:
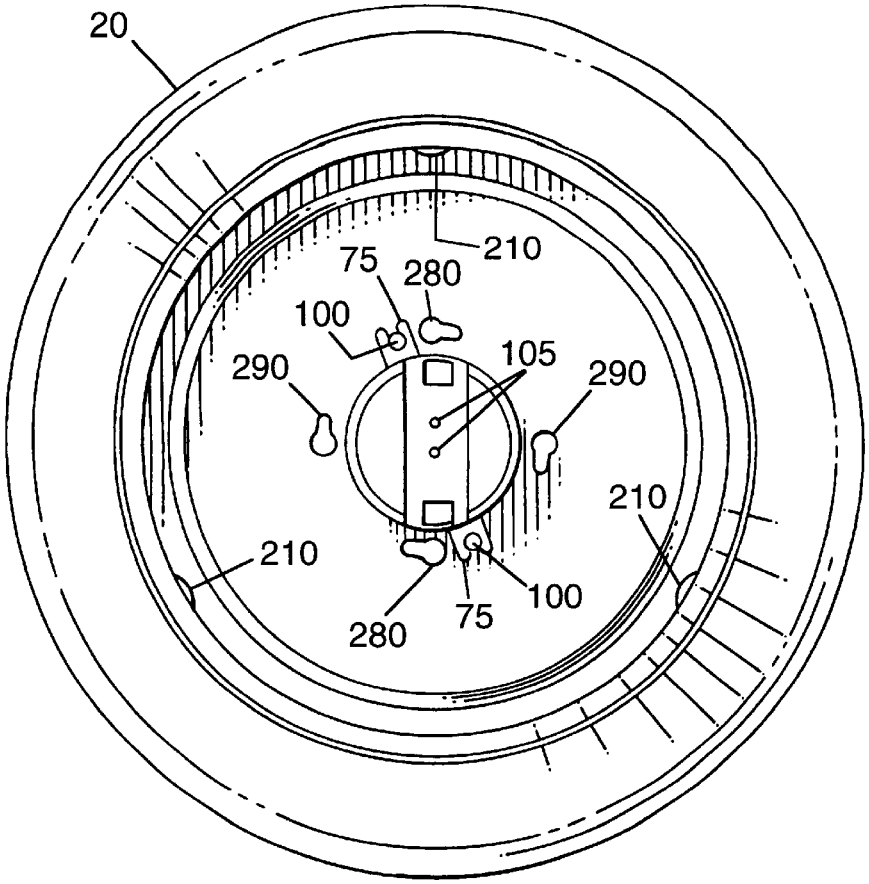
FIG. 4 is a bottom view of the base plate of the lighting fixture.

Shown in FIG. 4 is the decorative base 20 that provides the means for securing the lighting fixture to a standard electrical junction box. Two sets of mounting holes are available for installation of the lighting fixture; the first set of mounting holes 280 mate with both a standard 4 inch octagonal or a 4 inch round box—the second set of mounting holes 290 mate with a smaller 3 ¼ inch octagonal or round electrical box. The base attaches to the electrical junction box by passing two round head machine screws through the appropriate set of mounting holes, either mounting holes 280 or mounting holes 290.

Two additional holes 100 are shown that are used as a mounting means to attach the ballast receptacle assembly 70 to the base plate 20. Two pan-head self-tapping screws secure the ballast receptacle assembly 70 to the base plate 20 by passing the screw bodies through the forked shaped feet 75.

Figure 5:
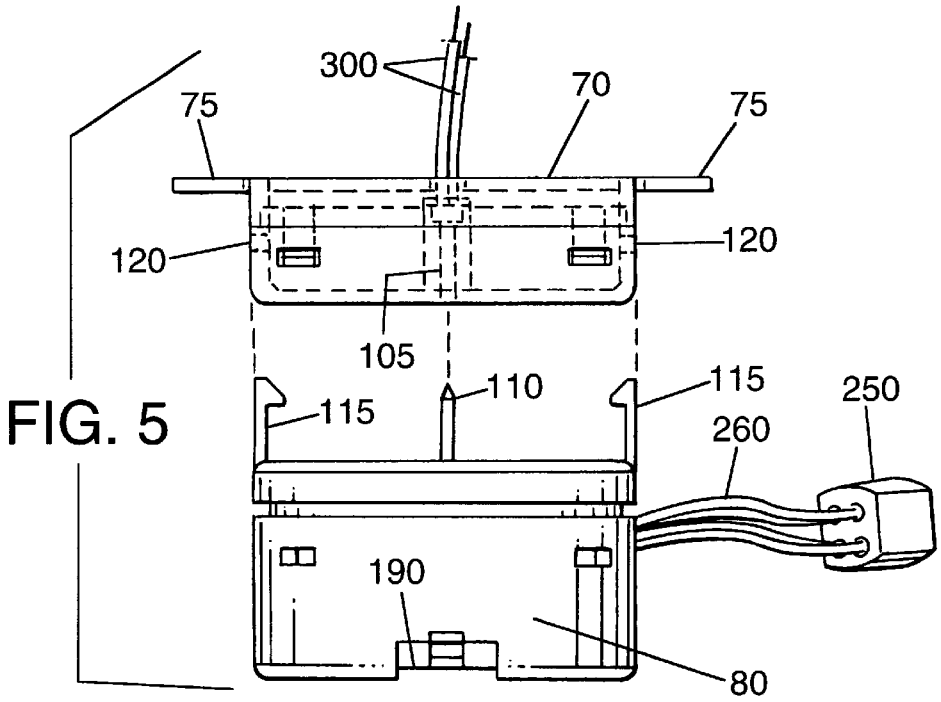
FIG. 5 is a side elevational view of the plug-in ballast and the pre-wired ballast receptacle arrangement.

Turning now to FIG. 5, there is shown a side elevational view of the plug-in ballast 80 and the transition module 65 that mounts to the base plate 20 and communicates with the power source through wires 300. The transition module 65 preferably comprises a pre-wired ballast receptacle assembly 70 of two components: a receptacle base 125 and cover 130. Two pig-tailed wires 300, connected to the female receptacle 105, in the ballast receptacle assembly 70 are available for subsequent connection to the household electrical wiring.

Figure 5A:
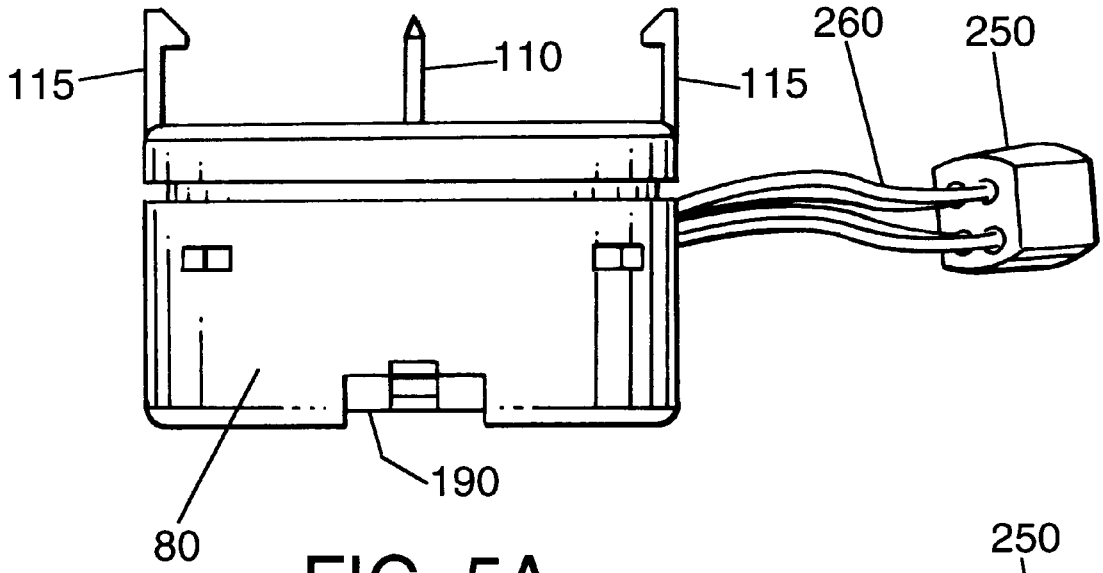
FIG. 5A is a side elevational view of the plug-in replaceable ballast.
Figure 5B:
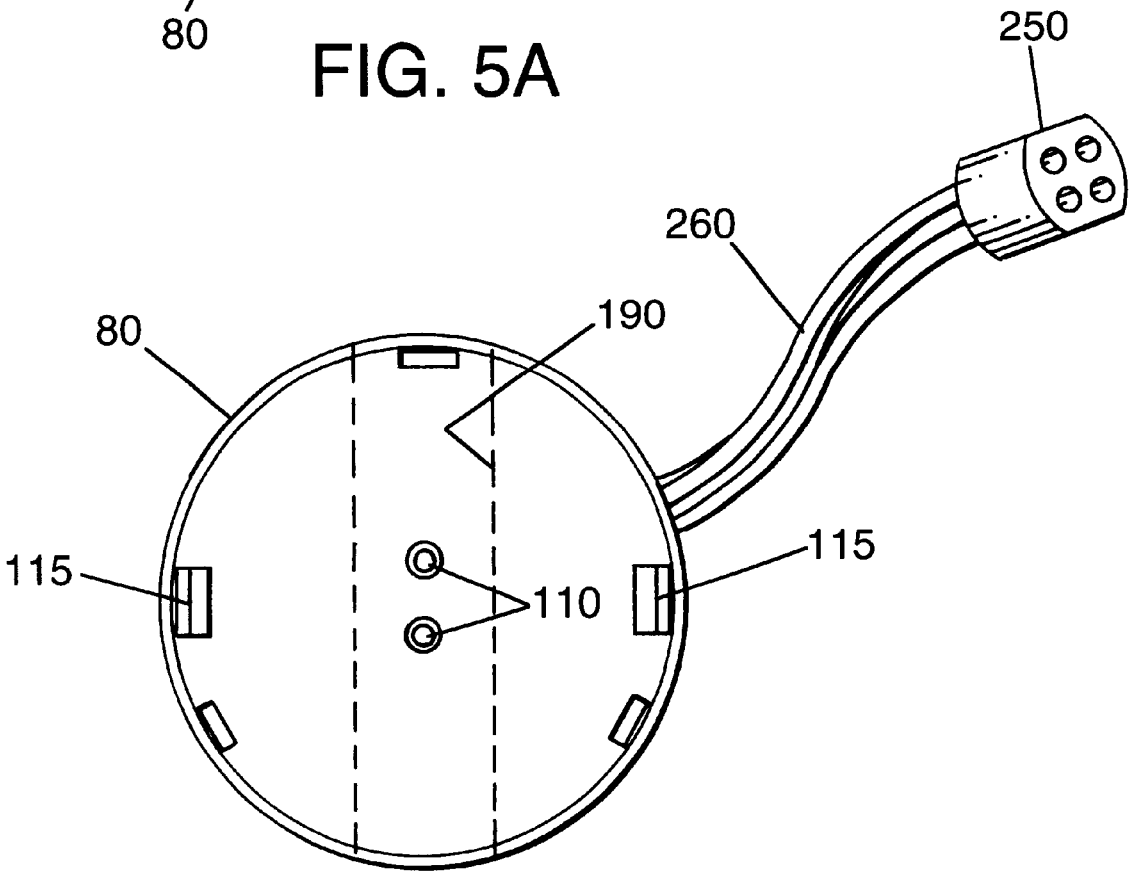
FIG. 5B is a top elevational view of the plug-in replaceable ballast.

As further shown in FIG. 5 and in FIGS. 5A and 5B, the plug-in replaceable ballast 80 has two input pins 110 that upon installation are inserted into the female receptacles 105. Two interlocking projections 115 engage with their respective mating recesses 120, maintaining the plug-in ballast 80 securely in position. The rectangular slotted channel 190 is designed to receive that lamp support bracket 40 at the time of ballast replacement. The 4-wired connector 250, attached to the end of cable 260, connects into the fluorescent lamp pins 270.

Figure 5C:
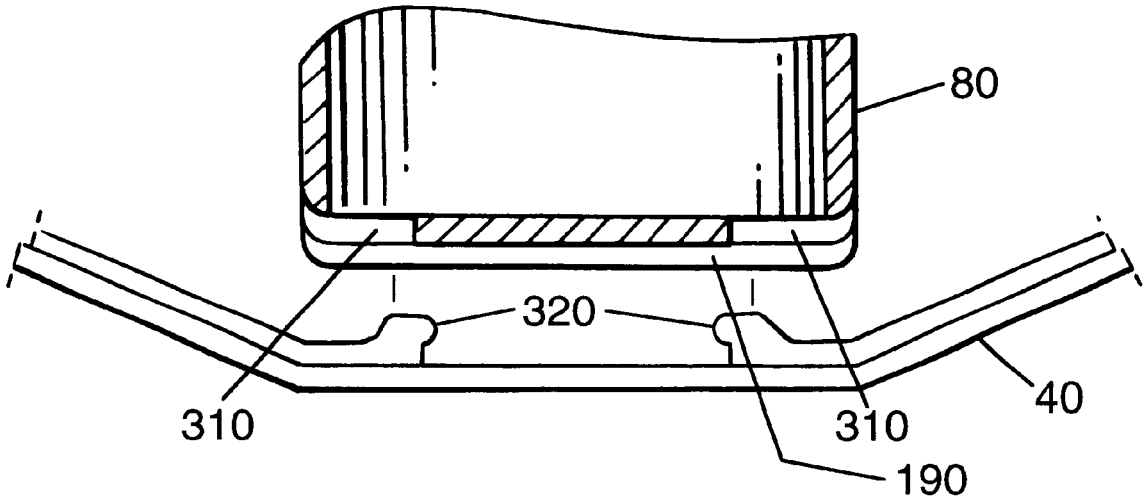
FIG. 5C is a fragmentary top view of the ballast housing detailing the rectangular holes that are used for attaching the lamp support bracket.
Figure 5D:
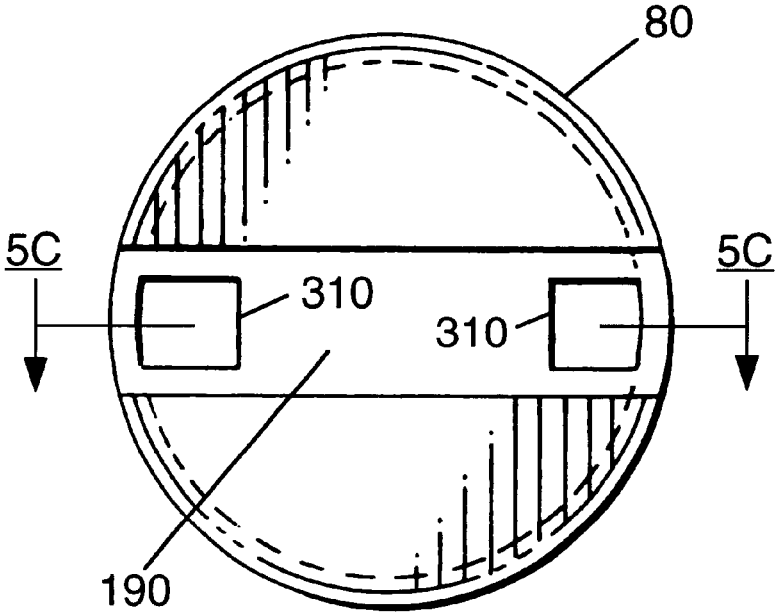
FIG. 5D is a fragmentary side sectional view, taken on line 5D–5D in FIG. 5C, illustrating the securement of the lamp support bracket to the ballast housing.

FIGS. 5C and 5D show the bat-winged lamp support bracket 40 mounted into slot 190. This rectangular slot 190 is found in the end of the ballast 80 and snaps into the inner surface of two square holes 310 where it is retained in a flush arrangement on ballast 80 by the two molded clips 320 on the lamp support bracket 40.

Figure 6:
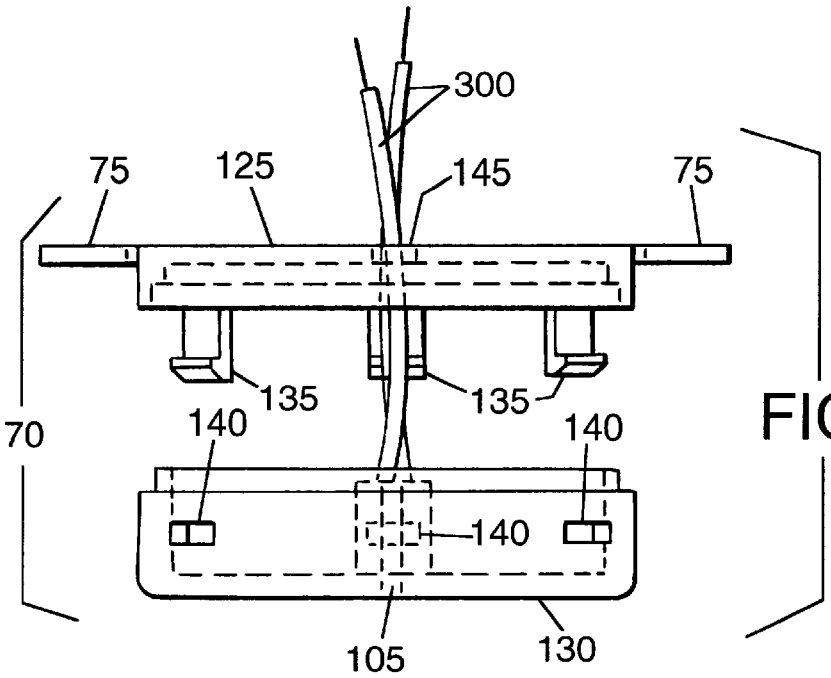
FIG. 6 is an exploded side elevational view of the pre-wired ballast receptacle assembly.

As further shown in FIG. 6, the ballast receptacle assembly 70 is comprised of two interlocking plastic pieces—the receptacle base 125 and the receptacle cover 130. Both pieces are made of an injection molded plastic or any other suitable insulating material.

The two electrical pig-tailed wires 300 are used to connect directly to the household wiring when the lighting fixture is first installed. These pig-tailed wires are pre-wired and connected to the female receptacles 105 during the time of assembly and manufacture. The wires pass through wiring hole 145 in the receptacle base 125.

Figure 6A:
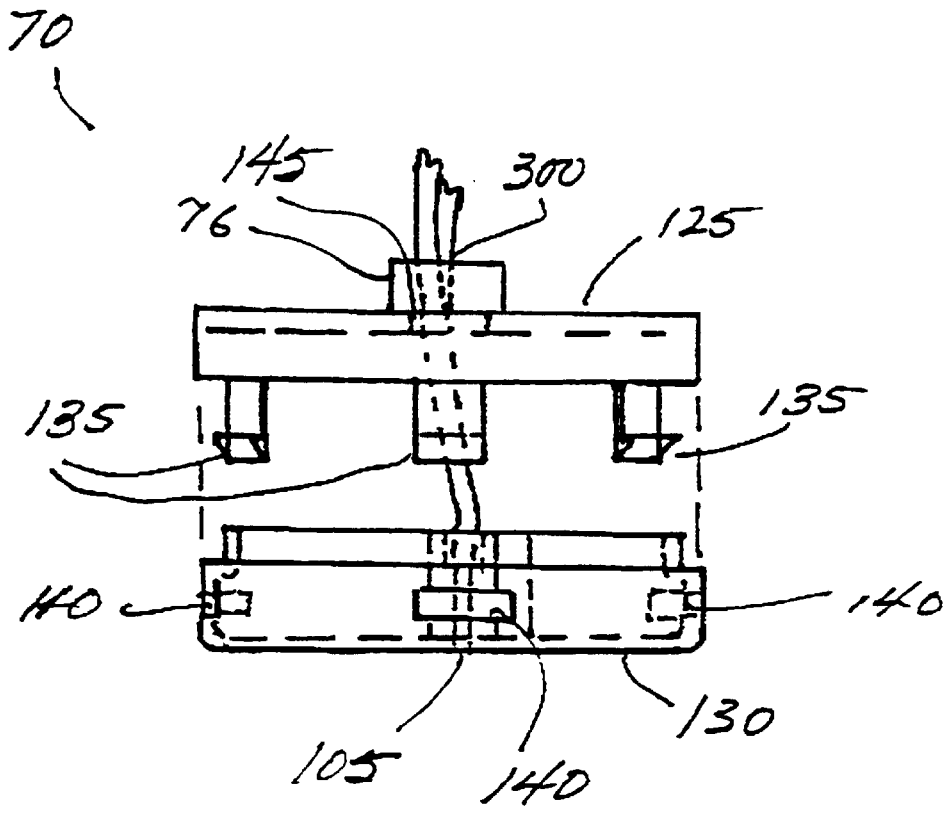
FIG. 6A is a side elevation of the ballast receptacle assembly with a projection that frictionally fits the base plate opening.
Figure 6B:
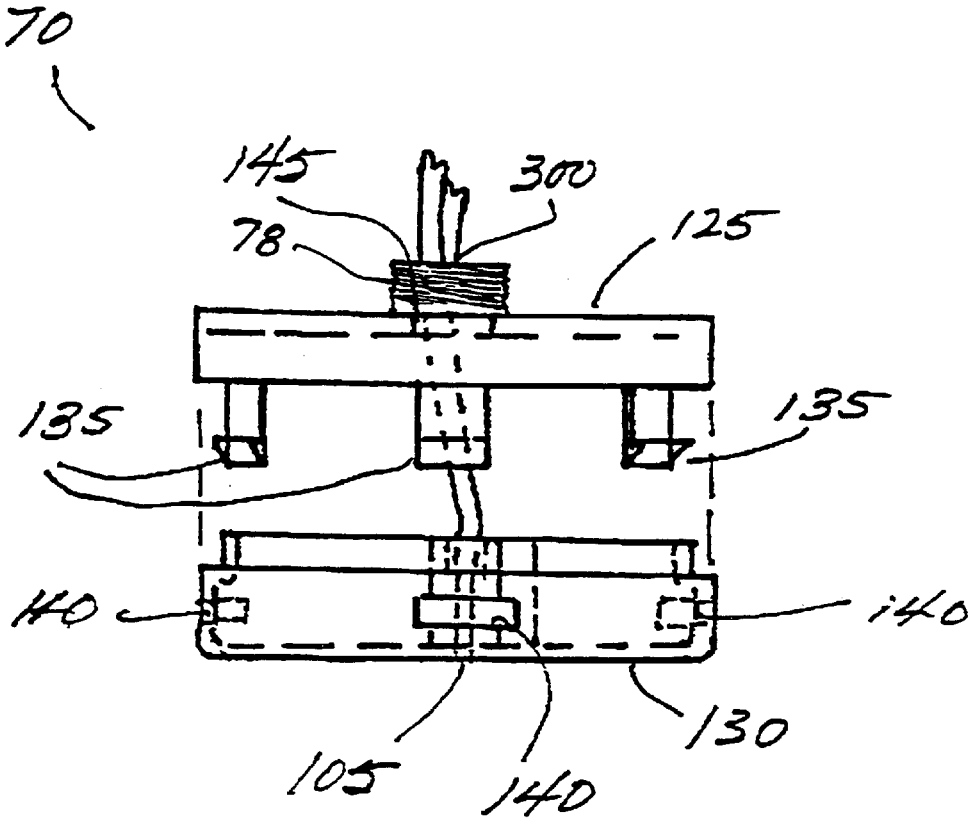
FIG. 6B is a side elevation of the ballast receptacle assembly wherein the projecting portion of the ballast receptacle comprises a threaded boss.
Figure 6C:
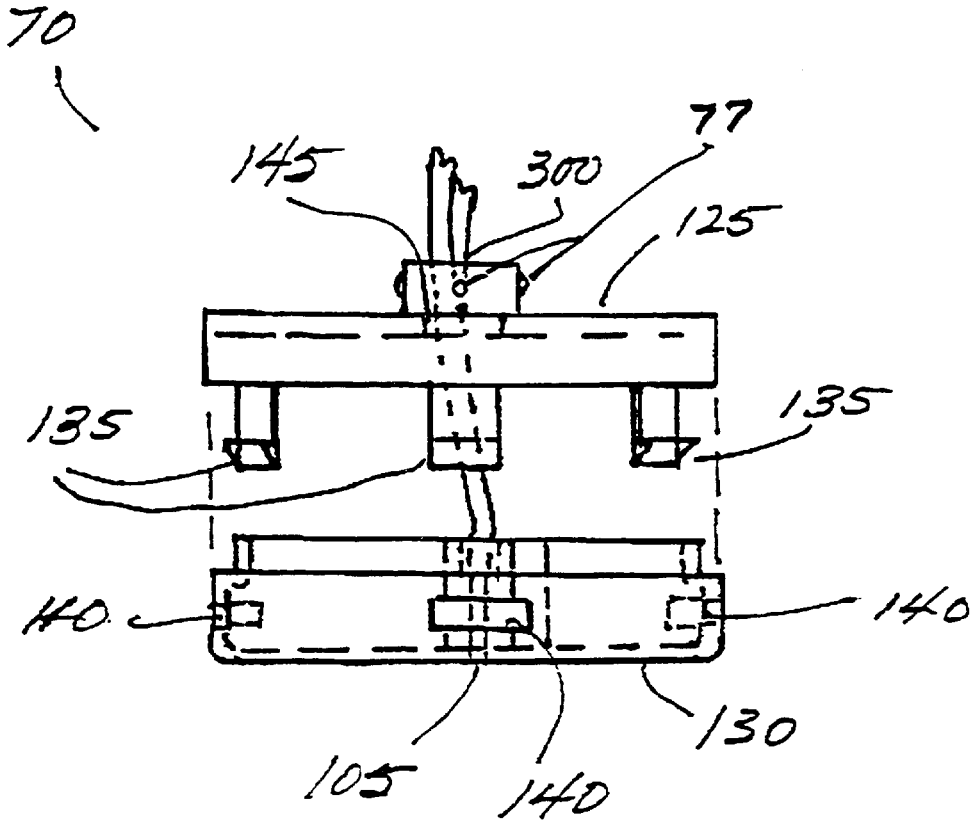
FIG. 6C is a side elevation of the ballast receptacle assembly having snaps on the receptacle projecting portion that fit into corresponding cavities bounding the base plate opening.

A second means for mounting the transition module 65 comprising the ballast receptacle 70 seen in FIG. 6A, wherein the ballast receptacle base 125 includes a projection 76 that frictionally fits the base plate opening or aperture 90. Another mounting means is shown in FIG. 6B, a side elevation of the ballast receptacle assembly wherein the projecting portion of the ballast receptacle comprises a threaded boss 78. FIG. 6C is a side elevation of the ballast receptacle assembly having snaps 77 on the receptacle projecting portion 76 that fit into corresponding cavities bounding the base plate opening 90.

Figure 7A:
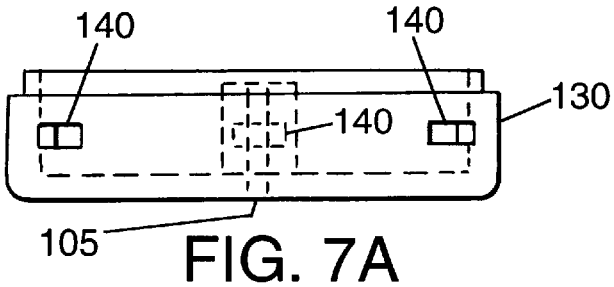
FIG. 7A is a side elevational view of the ballast receptacle cover.
Figure 7B:
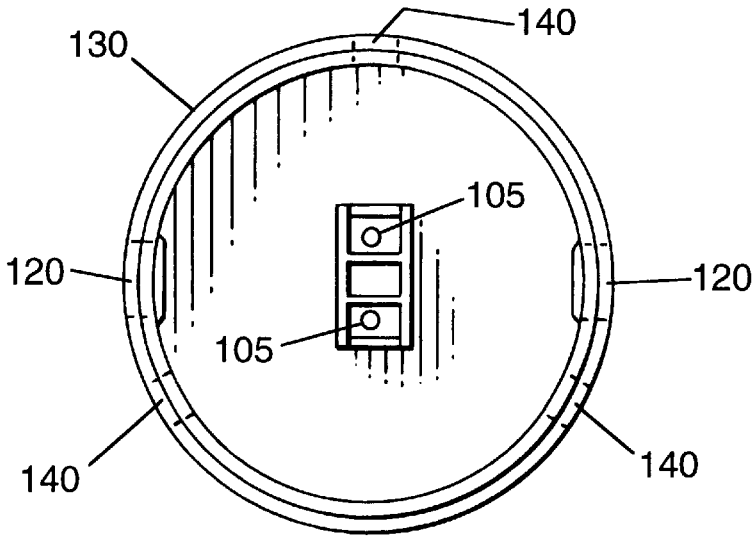
FIG. 7B is a top elevational view of the ballast receptacle cover.

FIGS. 7A and 7B, further detail the construction of the receptacle cover 130. Centrally located in the cover 130 is a molded internal projection to receive female receptacles 105, which will accept the pins from the plug-in ballast 80. There are three receiving slots 140 to engage and mate with the ramped surfaces of the interlocking tabs 135.

Figure 8A:
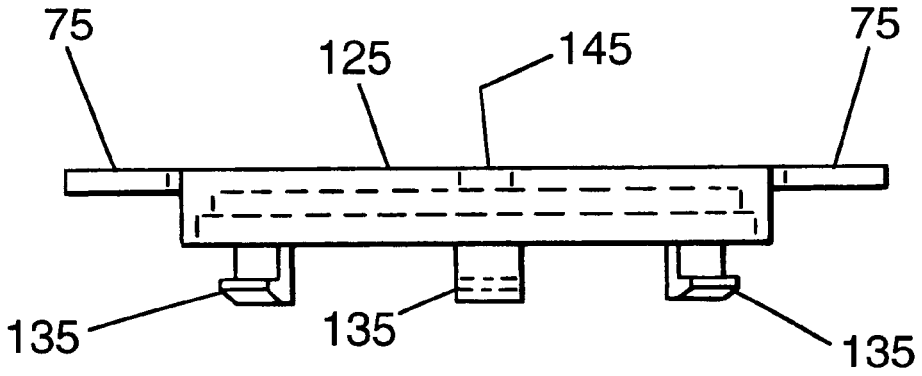
FIG. 8A is a side elevational view of the ballast receptacle base.
Figure 8B:
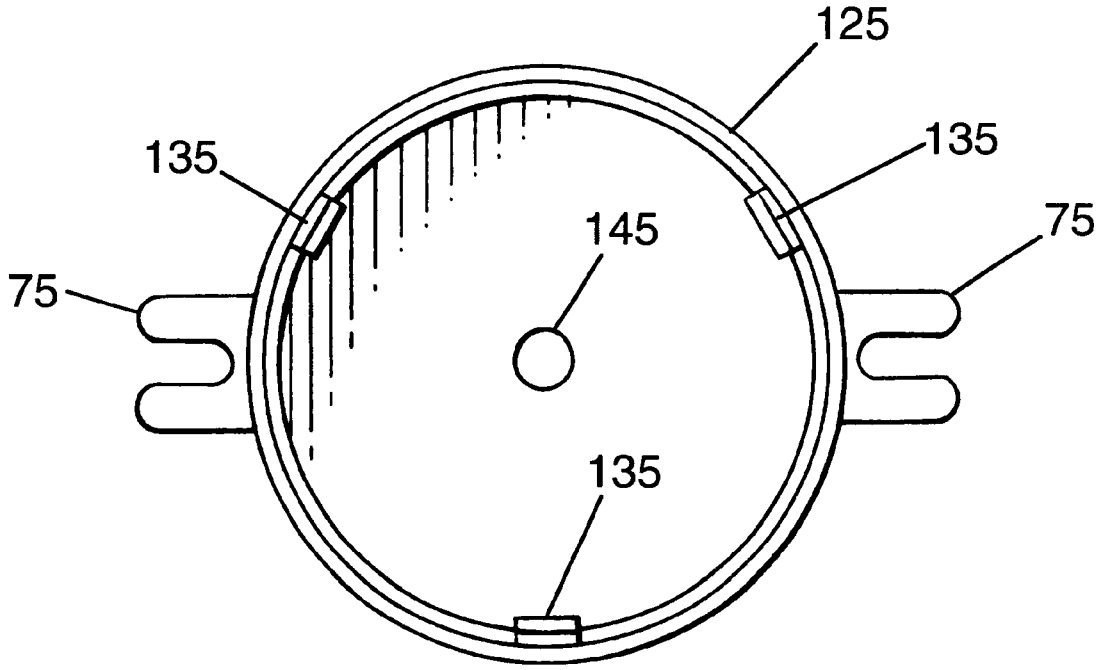
FIG. 8B is a top elevational view of the ballast receptacle base.

FIGS. 8A and 8B, further detail the construction of the receptacle base 125. The wiring hole 145 is used to pass the pig-tailed wires 300 through. Three interlocking tabs 135 extend from the receptacle base 125 and mate with three receiving slots 140, found in the sidewalls of the receptacle cover 130. Two forked mounting feet 75 project from opposite sides of the of the receptacle base 125 for the ease of mounting to the lighting fixture base 20 by using two self-tapping machine screws.

Figure 9:
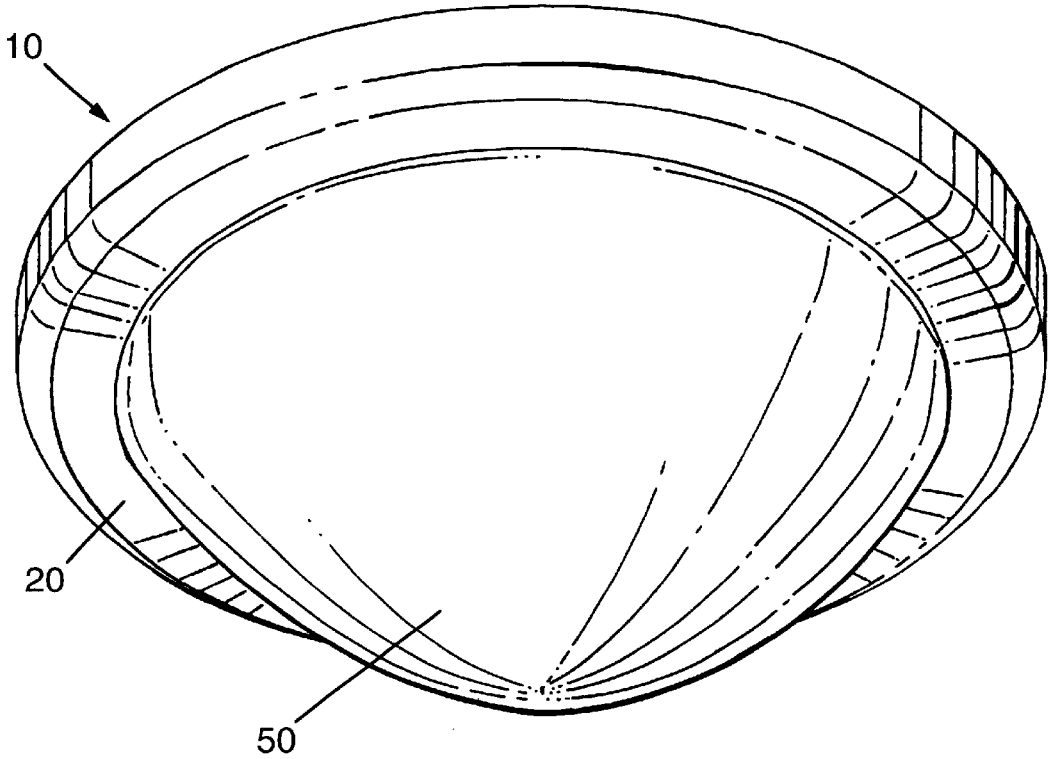
FIG. 9 is a perspective view of the fully assembled lighting fixture that incorporates the present invention having a threaded ballast housing.

The fluorescent lighting fixture 10, embodying the principles of the second embodiment of the present invention, is shown in FIG. 9 preferably as a ceiling mounted fixture. It may also be installed as a wall mounted fixture if so desired. The exterior components are comprised of a decorative lighting fixture base 20 and a decorative dome-shaped cover 50.

Figure 10:
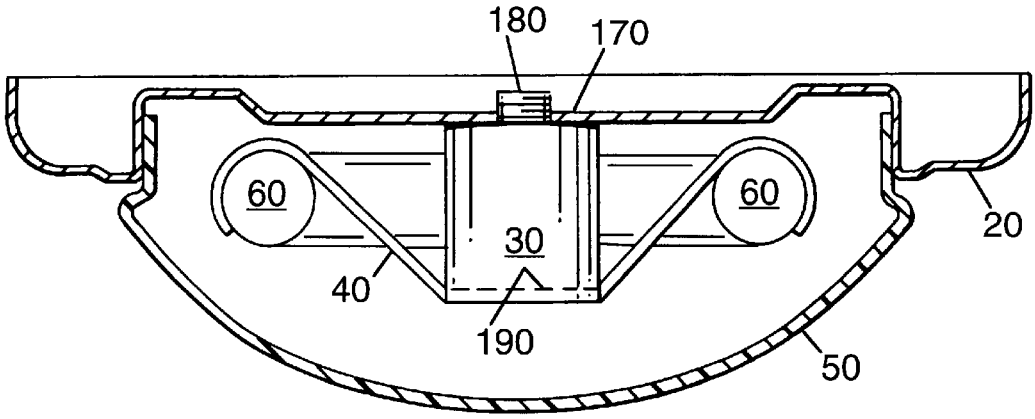
FIG. 10 is a side sectional view of the preferred embodiment of the present lighting fixture having a threaded ballast housing.

In FIG. 10, there is shown the screw lock base 180 of the lamp ballast housing 30 inserted into a recess 170 in the lighting fixture base 20, where it is rotatably drawn flat, abutting the surface of the fixture base into a binding frictional engagement. Snap-fitted into the slotted end 190 of the ballast housing 30 is a bat-winged shaped lamp support bracket 40. No special tools are required to engage or remove the lamp support bracket 40 from the ballast slot 190 in the ballast housing 30—only a moderate force needs to be exerted.

Referring now to FIG. 1, the lighting fixture 10 is shown in an exploded view, comprising the decorative lighting fixture base 20, the lamp ballast housing 30, the lamp support bracket 40, a circular fluorescent lamp 60, and a decorative dome-shaped cover 50.

Found at the wired end of the ballast housing 30 is the threaded boss 180 which is inserted into the recessed threaded hole 170 located in the center of the fixture base 20. The mean diameter of the threaded end is preferably 1.0625 inches, having 16 threads per-inch, however, any other suitable dimensions can be used. Approximately three complete turns of the ballast housing will draw the housing flat to fixture base, where it abuts the surface of the base into a binding frictional engagement, thereby preventing any further rotational tightening or removal.

The decorative dome-shaped cover 50 has a ridge 220 on its skirt 200 that extends circumferentially around the outer edge of this skirt—positioned so that the cover is securely held in place by snapping it past the three nibs or projections 210 found in the interior wall 230 of the fixture base 20. The dome-shaped cover 50 is translucent and made preferably from plastic, glass or any other suitable material.

A circular fluorescent lamp 60 may be installed so that it is inserted and nested into the cradled ends 240A and 240B of the lamp support bracket 40. After the fluorescent lamp 60 is mounted in the cradled ends 240A and 240B, the four-wire plug 250 at the end of the cable 260 extending from the ballast housing 30 may be plugged into the fluorescent lamp pins 270.

Figure 11:
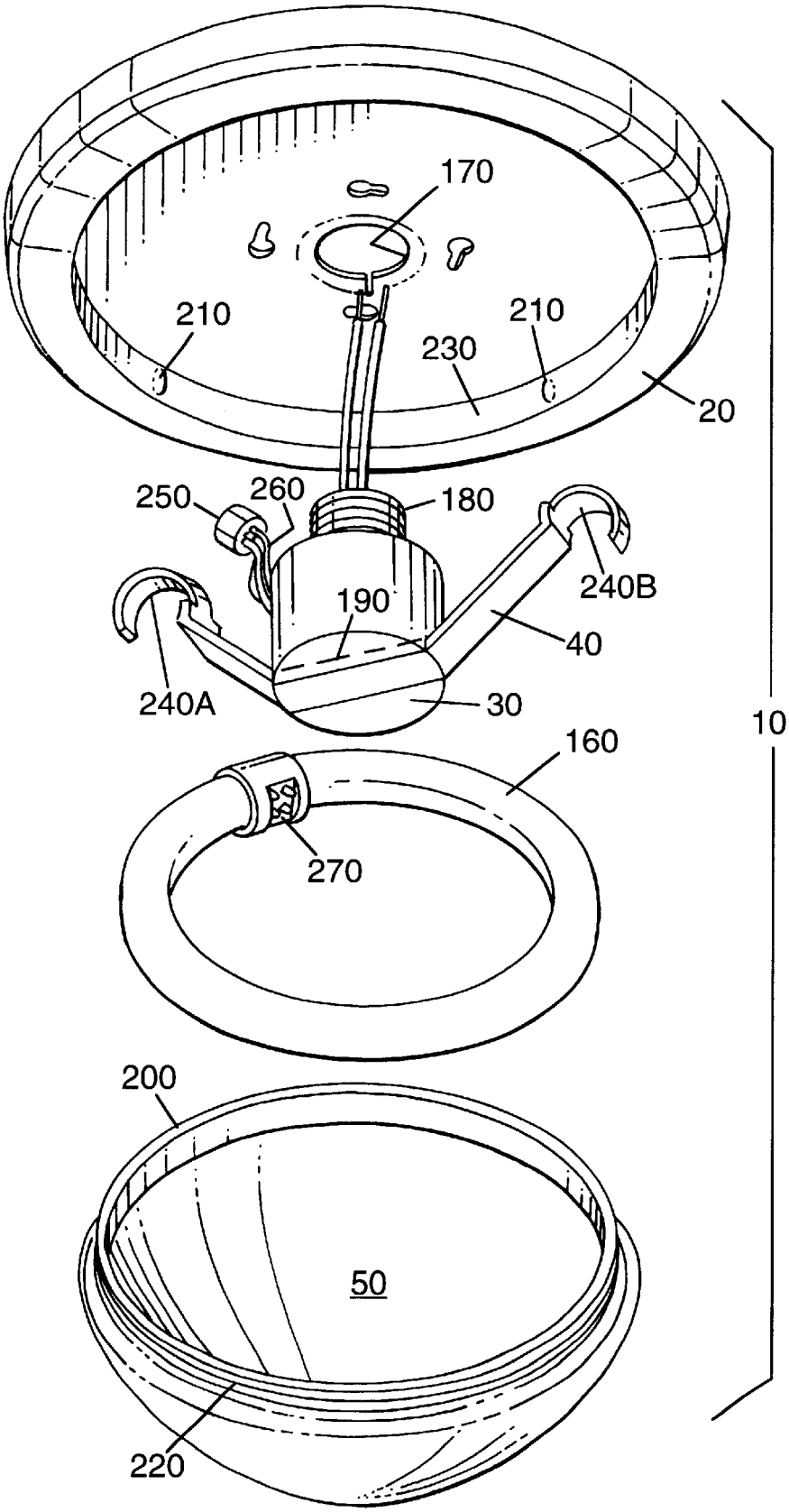
FIG. 11 is an exploded plan view of the lighting fixture as shown in FIG. 10.
Figure 11A:
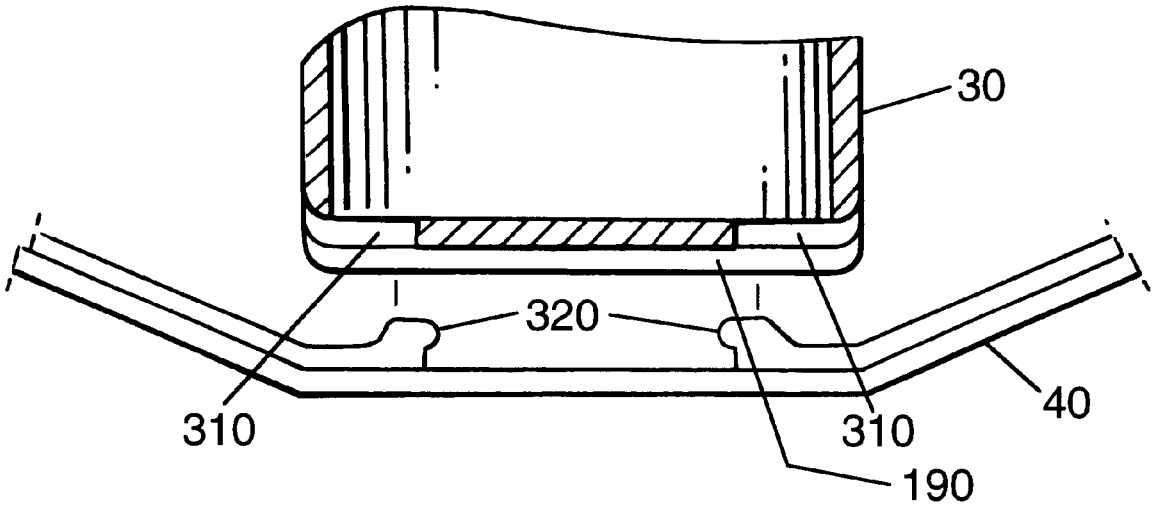
FIG. 11A is a fragmentary side sectional view illustrating the securement of the lamp support bracket to the ballast housing.
Figure 11B:
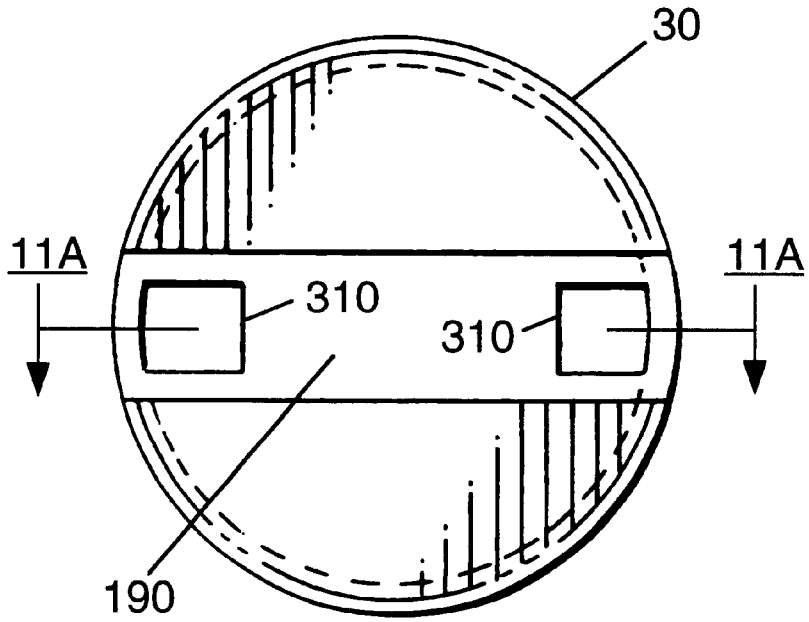
FIG. 11B is a fragmentary top view of the ballast housing detailing the rectangular holes that are used for attaching the lamp support bracket.

The bat-winged lamp support bracket 40 is mounted into slot 190 found in the end of the ballast housing 30 and snaps into the inner surface of two square holes 310 where it is retained by the two molded clips 320 on the lamp support bracket 40, as further detailed in FIGS. 11A and 11B.

Figure 12:
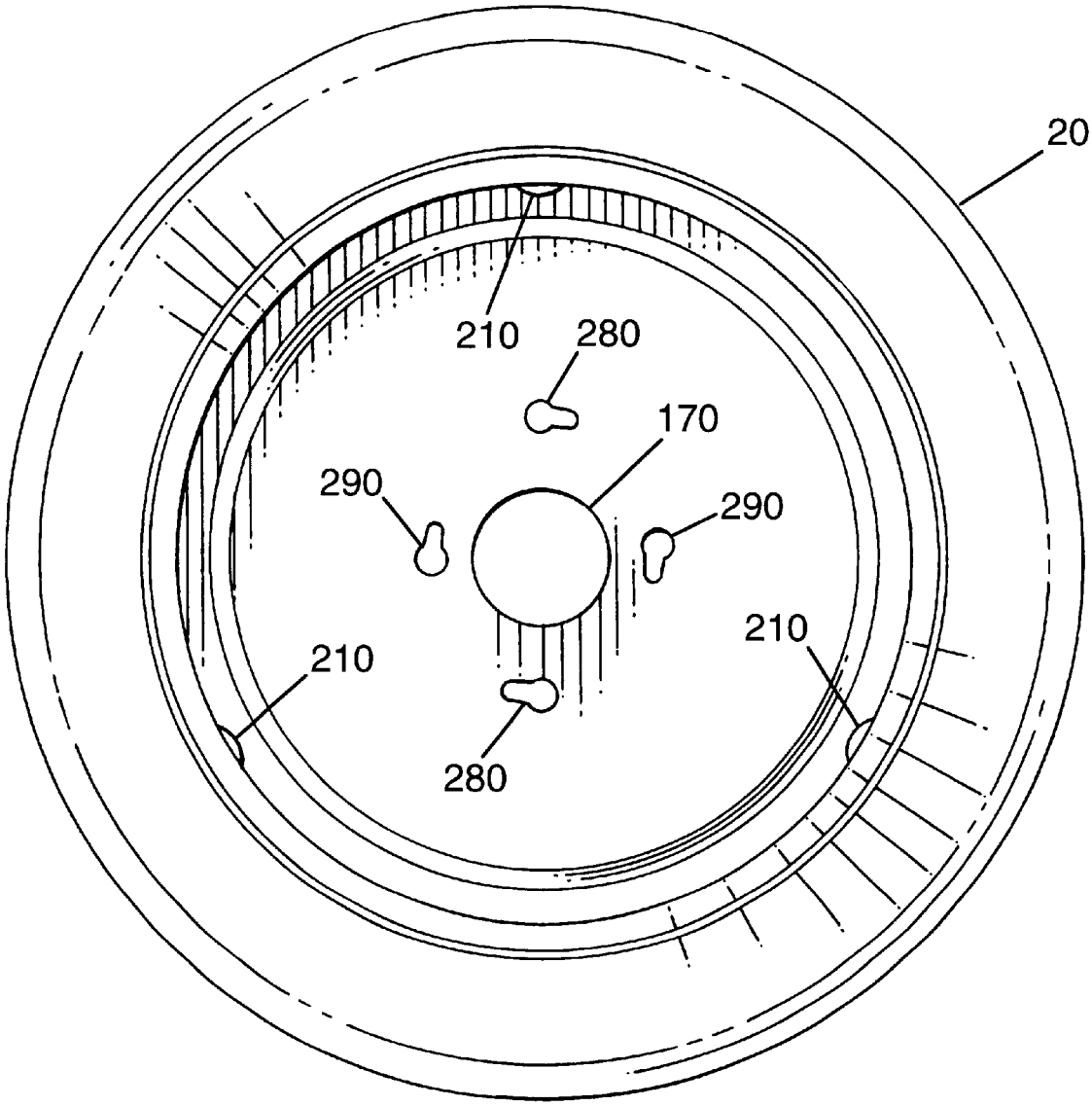
FIG. 12 is a bottom view of the base plate of the lighting fixture.

Shown in FIG. 12 is the decorative base 20 that provides the means for securing the lighting fixture to a standard electrical junction box. Two sets of mounting holes are available for installation of the lighting fixture; the first set of mounting holes 280 mate with both a standard 4 inch octagonal or a 4 inch round box—the second set of mounting holes 290 mate with a smaller 3 ¼ inch octagonal or round electrical box. The base attaches to the electrical junction box by passing two round head machine screws through the appropriate set of mounting holes, either mounting holes 280 or mounting holes 290.

Found in the center of fixture base 20 is the recessed threaded hole 170, where the threaded boss 180 of the ballast housing 30 is inserted.

Figure 13:
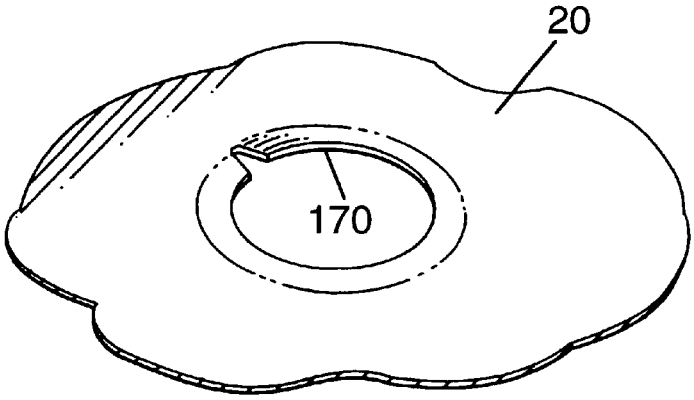
FIG. 13 is a fragmentary view of the receiving aperture in the base plate of the second embodiment of the present invention.
Figure 14:
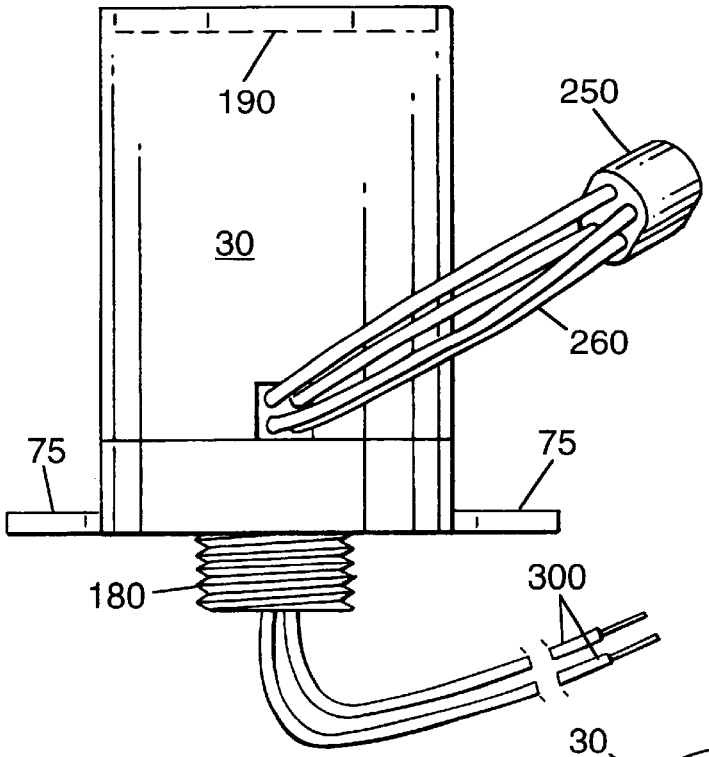
FIG. 14 is a side elevational view of a ballast enclosure detailing the screw lock base of the second embodiment of the present invention.
Figure 15:
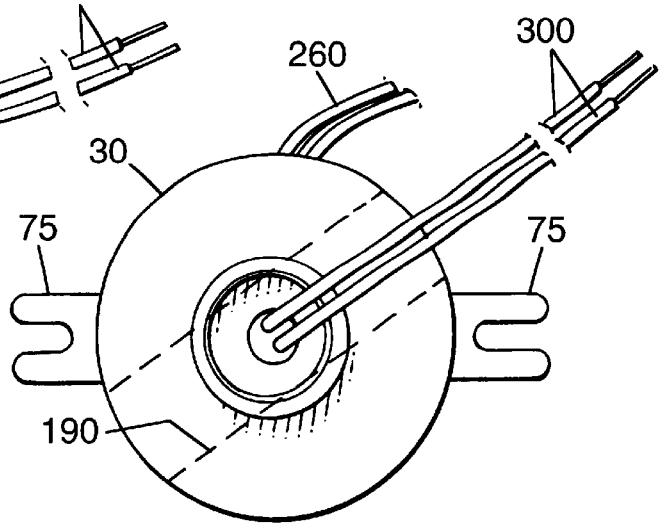
FIG. 15 is a bottom elevational view of a ballast enclosure detailing the screw lock base of the second embodiment of the present invention.

Referring in particular to FIGS. 13–15, there is shown the recessed threaded hole 170 stamped into the center of the fixture base 20 into which the threaded boss 180 of the ballast housing 30 is inserted. During the time allocated for assembly, approximately only three turns of the ballast assembly are required.

Because there are only three major components comprising the lighting fixture 10—the fixture base 20, the ballast 30 with lamp bracket 40, and the decorative dome-shaped cover 50, the assembly time is drastically reduced.

Even the installation is greatly simplified. First, the electrical wires 300 are connected to the household wiring and the protective earth ground wire (not shown) is attached to the earth ground wire (identified as being colored green). Second, the fixture base 20 is secured to the electrical junction box using two round head machine screws through the appropriate mounting holes, either 280 or 290. Third, a circular fluorescent lamp 60 is inserted into the lamp support bracket 40, then inserting plug 250 into fluorescent lamp pins 270. The decorative dome-shaped cover is then snapped into the fixture base 20, completing the installation.

Figure 16:
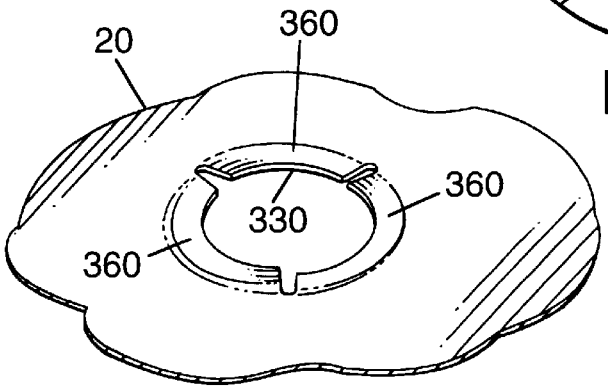
FIG. 16 is a fragmentary view of the receiving aperture in the base plate of an alternative embodiment for receiving a twist lock ballast housing.
Figure 17:
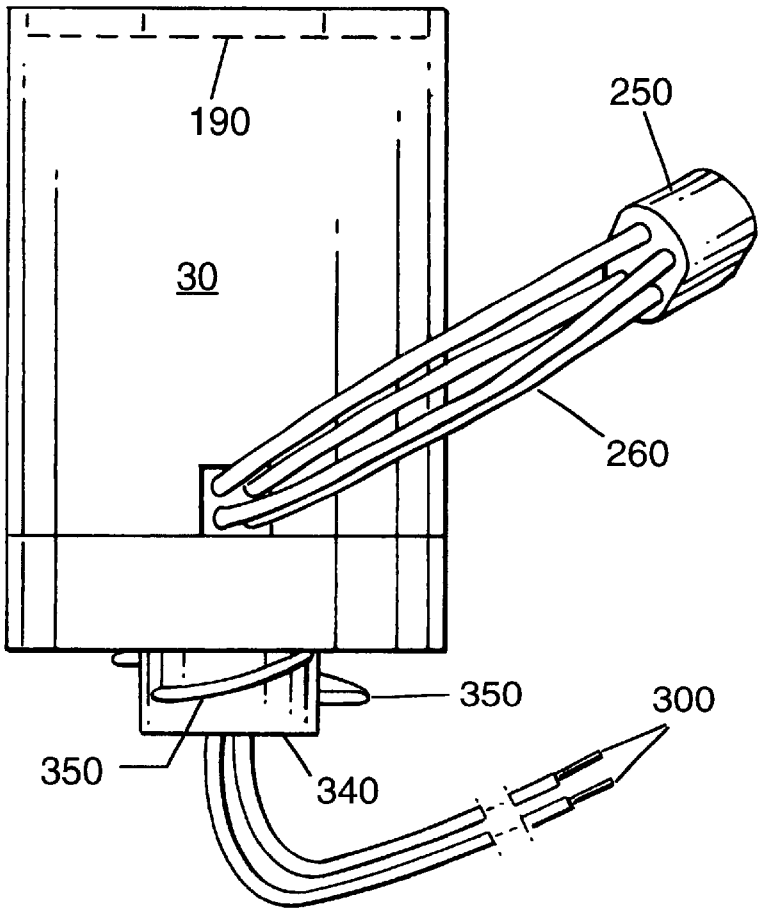
FIG. 17 is a side elevational view of a ballast enclosure detailing the twist lock base of the alternative embodiment of the present invention.
Figure 18:
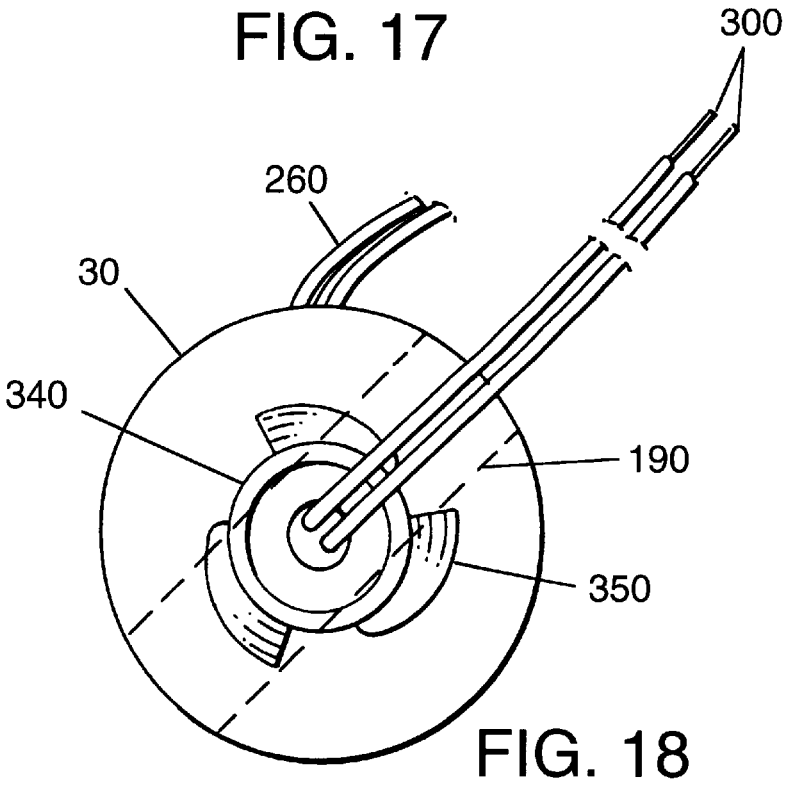
FIG. 18 is a bottom elevational view of a ballast enclosure detailing the twist lock base of the alternative embodiment of the present invention.

In an alternative embodiment, as shown in FIGS. 16–18, a twist lock base is used to mount the ballast and lamp support bracket assembly. A plurality of vanes 350 found on the twist lock base 340 of the ballast housing 35 is inserted into the recess 330 found in the base 20 of the lighting fixture 10. By rotating the ballast housing 35 as it is inserted into recess 330 of the lighting fixture base 20, the vanes 350 engage the ramped screw-threadlike depressions 360 in the lighting fixture base 20 to provide a rapid secure attachment support for the illumination source. Again, as in the case of the preferred embodiment, the ballast housing 35 is rotatably drawn flat, abutting the surface of the fixture base 20 into a binding frictional engagement.

It should be understood that there may be numerous modifications, advances or changes that can be made to the present invention, but in doing so, it is intended that they should not detract from the true spirit of the present invention.

I claim:

1. A fluorescent lighting fixture, comprising:

a base plate having an opening therein and removably securable to at least a ceiling or a wall;

a light assembly, including a fluorescent lamp and a lamp ballast positioned at the opening, further comprising a transition module mounted on the base plate and communicating with a power source; the transition module having a cylindrical projection to maintain the assembly in position at the opening; the cylindrical projection comprising a threaded boss and the opening having complementary threads, whereby the boss is threaded to the base to removably secure the module to said base; and, means for replacing the ballast without rewiring, for replacement of a non-functional ballast without any tools or dismantling the fixture.

2. The fluorescent lighting fixture according to claim 1, the transition module comprising a pre-wired ballast receptacle having a pigtail for connection to the power source and a female plug receptacle to obviate a necessity for further wiring.

3. The fluorescent lighting fixture according to claim 2, the lamp ballast including a ballast housing with a first and a second end, a male plug at the first housing end that mates with the ballast receptacle, for replacing the ballast without any rewiring by unplugging a non-functional ballast from the receptacle and plugging in a replacement ballast.

4. The fluorescent lighting fixture according to claim 3, the ballast receptacle including an at least one mating recess and the ballast housing further comprising an at least one interlocking projection for engagement with the at least one recess to maintain the ballast securely plugged in the receptacle.

5. The fluorescent lighting fixture according to claim 4, further comprising a means for retaining said fluorescent lamp near the base, said means associated with the housing.

6. The fluorescent lighting fixture according to claim 5, the means for retaining comprising a lamp support bracket for supporting said fluorescent lamp.

7. The fluorescent lighting fixture according to claim 6, the support bracket including a pair of clips and the housing second end having a corresponding pair of mounting holes to receive the clips, whereby the lamp support bracket is snap-fitted to the ballast housing.

8. The fluorescent lighting fixture according to claim 7, the ballast housing second end having a transverse slot grooved into an end surface thereof with the mounting holes located in the slot, whereby the support bracket is flush mounted on the ballast housing.

9. The fluorescent lighting fixture according to claim 8, the support bracket having a bat-wing shape for positioning the lamp near the base to maximize the light provided while minimizing a vertical displacement of the fixture.

10. The fluorescent lighting fixture according to claim 6, wherein the support bracket is contiguous with said ballast housing.

11. The fluorescent lighting fixture according to claim 6, further including a translucent cover in a snap-fitted engagement with said base for covering the light assembly.

12. The fluorescent lighting fixture according to claim 11, support bracket including cradle ends wherein the lamp is nested in the cradle ends; and, further comprising a four-wire output plug emanating from the ballast to receive four corresponding lamp pins to connect the lamp when nested in said ends.

13. A method for replacing a ballast of a fluorescent lighting fixture without rewiring the fixture, said fluorescent lighting fixture comprising a base plate having an opening therein and removably securable to at least a ceiling or a wall and a pre-wired ballast receptacle positioned at the opening, comprising the steps of:

unplugging a non-functional ballast from the pre-wired ballast receptacle of the lighting assembly;

plugging a replacement ballast into the ballast receptacle; and connecting a fluorescent lamp to the replacement ballast wherein the ballast includes a housing and the unplugging step includes the steps of unplugging a four-wire ballast plug from the fluorescent lamp; and, unsnapping a lamp retainer bracket snap-fitted to the ballast housing.

14. A fluorescent lighting fixture, comprising:

a base plate having an opening therein and removably securable to at least a ceiling or a wall;

a light assembly including fluorescent lamp with four input pins and a lamp ballast having two ballast pins at a first end and a four-wire plug at a second end, a transition module with pigtail wires communicating with a female receptacle adapted to receive the ballast pins, the fixture formed by the steps of securing the base plate to the ceiling or the wall, connecting the pigtail to a power source, mounting the module on the base, plugging the ballast into the module and connecting the ballast plug to the lamp, whereby the ballast is replaceable without rewiring or dismantling the fixture.

* * * * *